US006112343A

United States Patent [19]

Dixon

[11] Patent Number: 6,112,343

[45] Date of Patent: Sep. 5, 2000

[54] INFANT BATHTUB WITH HOOK

[75] Inventor: Fredrick P. Dixon, Roswell, Ga.

[73] Assignee: Evenflo Company, Inc., Vandalia, Ohio

[21] Appl. No.: 09/178,299

[22] Filed: Oct. 23, 1998

[51] Int. Cl.[7] ..... A47K 3/024

[52] U.S. Cl. ..... 4/572.1; 4/586; 4/571.1

[58] Field of Search ..... 4/572.1, 573.1, 4/571.1, 586, 587

[56] References Cited

U.S. PATENT DOCUMENTS

| | | |
|---|---|---|
| Re. 32,806 | 12/1988 | Gurolnick . |
| D. 149,403 | 4/1948 | Brecher . |
| D. 188,838 | 9/1960 | Johnson . |
| D. 191,193 | 8/1961 | O'Brien et al. . |
| D. 205,992 | 10/1966 | Gardner . |
| D. 350,598 | 9/1994 | Wise et al. . |
| D. 360,933 | 8/1995 | Crossley et al. . |
| D. 370,528 | 6/1996 | Kiester . |
| 795,536 | 7/1905 | Neal . |
| 1,073,435 | 9/1913 | Owsley . |
| 1,296,238 | 3/1919 | Vanderhoof . |
| 1,369,638 | 2/1921 | Edmonds et al. . |
| 1,512,068 | 10/1924 | Thornburg . |
| 1,560,261 | 11/1925 | Kleineschay . |
| 1,584,240 | 5/1926 | Mirkin . |
| 1,658,944 | 2/1928 | Schaeffer . |
| 1,717,441 | 6/1929 | Engel . |
| 1,734,462 | 11/1929 | Gottlieb . |
| 1,758,071 | 5/1930 | Bleustein . |
| 2,089,801 | 8/1937 | Kennedy . |
| 2,193,374 | 3/1940 | Notter . |
| 2,222,070 | 11/1940 | Graves . |
| 2,285,900 | 6/1942 | Chapman . |
| 2,323,454 | 7/1943 | Chambers . |
| 2,358,003 | 9/1944 | De Puy . |
| 2,389,362 | 11/1945 | Harper . |
| 2,460,308 | 2/1949 | Pribil . |
| 2,461,744 | 2/1949 | Lafield . |
| 2,487,228 | 11/1949 | Feichtmeir . |
| 2,491,223 | 12/1949 | Stadlman . |
| 2,495,482 | 1/1950 | Rogatz . |
| 2,495,965 | 1/1950 | Gustaveson . |
| 2,504,287 | 4/1950 | Ward . |
| 2,507,848 | 5/1950 | Bashaw . |
| 2,514,767 | 7/1950 | Kennedy . |
| 2,531,724 | 11/1950 | Cevasco . |
| 2,535,259 | 12/1950 | Boyington . |
| 2,547,564 | 4/1951 | Burke . |
| 2,547,743 | 4/1951 | Burr et al. . |
| 2,548,301 | 4/1951 | Gibson . |
| 2,560,575 | 7/1951 | Holland, Sr. . |
| 2,562,628 | 7/1951 | McPeake, Jr. . |
| 2,563,076 | 8/1951 | Schreckengost . |

(List continued on next page.)

FOREIGN PATENT DOCUMENTS

| | | |
|---|---|---|
| B-41263/93 | 12/1993 | Australia . |
| 965770 | 9/1950 | France . |
| 1236955 | 6/1960 | France . |
| 1439625 | 8/1966 | France . |
| 3623-095 | 10/1987 | Germany . |
| 5289A | 7/1894 | Sweden . |
| 561534 B | 5/1973 | Switzerland . |
| WO 88/03000 | 5/1988 | WIPO . |

*Primary Examiner*—David J. Walczak
*Attorney, Agent, or Firm*—Robert G. Crouch; Holland & Hart LLP

[57] ABSTRACT

An infant bathtub having a tub of unitary construction, a foam pad attached thereto, a sling selectively and removably attachable to a lip of the tub, and a hook selectively and removably attachable to a bottom surface of the tub. The hook includes shoulders and a notch formed thereon that mate with channels and resilient tabs formed on the bottom surface of the tub. The receptacle is located on the bottom surface of the tub in the position relative to the center of mass so that when the hook is installed therein, the infant bathtub will hang from a shower curtain rod in a substantially vertical orientation. The sling can be removably attached to the infant bathtub along a lip formed on the tub and the clips can be positioned relative to various ribs formed at the head end and foot end of the tub.

20 Claims, 4 Drawing Sheets

U.S. PATENT DOCUMENTS

| | | | |
|---|---|---|---|
| 2,607,925 | 8/1952 | De Puy . | |
| 2,644,953 | 7/1953 | Kennedy . | |
| 2,645,782 | 7/1953 | Kennedy . | |
| 2,724,839 | 11/1955 | Kennedy . | |
| 2,751,603 | 6/1956 | Brinkman . | |
| 2,836,833 | 6/1958 | Carlson . | |
| 2,841,798 | 7/1958 | Kennedy . | |
| 2,854,671 | 10/1958 | Setecka . | |
| 2,957,184 | 10/1960 | Smith . | |
| 2,973,889 | 3/1961 | Phillips . | |
| 2,985,889 | 5/1961 | Fain et al. . | |
| 3,031,229 | 4/1962 | Symbaluk . | |
| 3,046,567 | 7/1962 | Jackson . | |
| 3,086,222 | 4/1963 | Hall et al. . | |
| 3,235,306 | 2/1966 | Chernivsky . | |
| 3,528,111 | 9/1970 | Chou | 4/572.1 |
| 3,545,016 | 12/1970 | Schorken . | |
| 3,595,224 | 7/1971 | Walter . | |
| 4,266,306 | 5/1981 | Lee . | |
| 4,602,394 | 7/1986 | Allen et al. . | |
| 4,719,653 | 1/1988 | Bishop et al. . | |
| 4,974,267 | 12/1990 | Sheu . | |
| 5,181,284 | 1/1993 | Raphael et al. . | |
| 5,271,107 | 12/1993 | Gof . | |
| 5,276,926 | 1/1994 | Lopez . | |
| 5,297,300 | 3/1994 | Sheu . | |
| 5,361,430 | 11/1994 | Wise . | |
| 5,388,286 | 2/1995 | Davenport . | |
| 5,406,655 | 4/1995 | Sahlin . | |
| 5,425,149 | 6/1995 | Crossley et al. . | |
| 5,491,850 | 2/1996 | Kiester . | |
| 5,588,159 | 12/1996 | Poulson et al. . | |
| 5,599,063 | 2/1997 | Lister et al. . | |
| 5,636,391 | 6/1997 | Greene, III | 4/572.1 |
| 5,722,100 | 3/1998 | Jozwiak . | |

INFANT BATHTUB WITH HOOK

The present invention relates to an infant bathtub adapted for bathing infants in a self-contained tub specially designed therefor, and more particularly, relates to an infant bathtub with structure for improving the ability of the tub to completely dry out between uses, and a method relating thereto.

BACKGROUND OF THE INVENTION

Self-contained infant bathtubs for bathing infants on countertops, in sinks, and in full-sized tubs are well known. Such infant bathtubs are typically used for bathing infants up to one to two years of age. These tubs are typically used on a regular, periodic basis, and may be used as frequently as every day. For a variety of reasons, the tubs may not be fully drained in between uses. Nevertheless, it is preferable for the tubs to completely dry out between uses as standing water left in the tub may cause mildew and the like to form.

One example of an infant bathtub is disclosed in U.S. Pat. No. Re. 32,806, issued to Gurolnick. Gurolnick shows one of the terminal ends of the tub having a handle with a recess formed on the undersurface thereof. According to Gurolnick, the recess is suitably configured for suspending the device from a towel rack or shower curtain rod in a shower stall. Unfortunately, there are several drawbacks to the Gurolnick approach. First of all, the Gurolnick handle cannot be separated from the tub itself, which may at times prove to be a disadvantage. Second, the particular shape of the Gurolnick handle as disclosed would be difficult to manufacture in an injection-molding process because of the nature of the recess in the handle. This could cause the tub to be prohibitively expensive to produce both from an initial capital expense standpoint due to the complex mold necessary, and from a time-to-produce standpoint because the cycle time of the tool to produce the tub would have to be longer in order to produce the handle feature described.

Third, by hanging the tub from the end of a member extending out from the head end of the tub as shown in Gurolnick, the lower end of the tub may hang down so close to the ground as to allow a toddler to pull or knock the tub off of the shower curtain rod or towel rack. Fourth, the handle disclosed in Gurolnick extends across the entire width of the tub which is a significant use of material that may also increase the cost of the tub. Fifth, since the handle is a unitary portion of the Gurolnick tub, it appears to be composed of the same material as the remainder of the tub. The different functions of (1) hanging the tub from a shower curtain rod or towel rack and (2) providing a suitable surface for containing water in a tub for bathing by an infant may be different enough as to call for different plastic materials. Sixth, the design shown in Gurolnick does not appear to be such as to rest in a stable and substantially horizontal position on a support surface due to the relative positions of the bottoms of the two trough portions and the handle in the Gurolnick tub.

It may also be desirable to provide a means for suspending a small infant above the bathtub, wherein the means could be easily dried out as well. It is against this background, and the desire to solve the problems of the prior art, that the present invention has been developed.

SUMMARY OF THE INVENTION

To achieve the foregoing and other objects and in accordance with the purposes of the present invention, as embodied and broadly described therein, the present invention is directed to an infant bathtub selectively suspendable from a shower curtain rod or the like. The infant bathtub includes a tub having a front side configured and adapted for containing liquid when the tub is in an operative position, the tub also having a back side with portions thereof adapted for resting on a support surface when the tub is in the operative position, the back side having a receptacle defined thereon. The infant bathtub also includes a hook having features defined thereon for mating with the receptacle on the back side of the tub, the hook being selectively attachable to the receptacle on the back side of the tub.

The present invention is also directed to a method of manufacturing an infant bathtub with a hook for suspending the bathtub from a shower rod curtain or the like. The method includes producing a bathtub having a receptacle defined on a back side thereof, producing a hook separately from the bathtub, and sliding the hook into the receptacle.

The present invention is also directed to an infant bathtub including a tub adapted and configured for containing fluid therein, the tub having a lip defined along an upper edge thereof, with a plurality of features defined on the lip. The infant bathtub also includes a sling selectively suspendable from the upper edge of the tub, the sling having a plurality of connecting members engageable with the lip and the features defined thereon.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings.

DETAILED DESCRIPTION OF THE PREFERRED EMBODIMENTS

Figure 1:
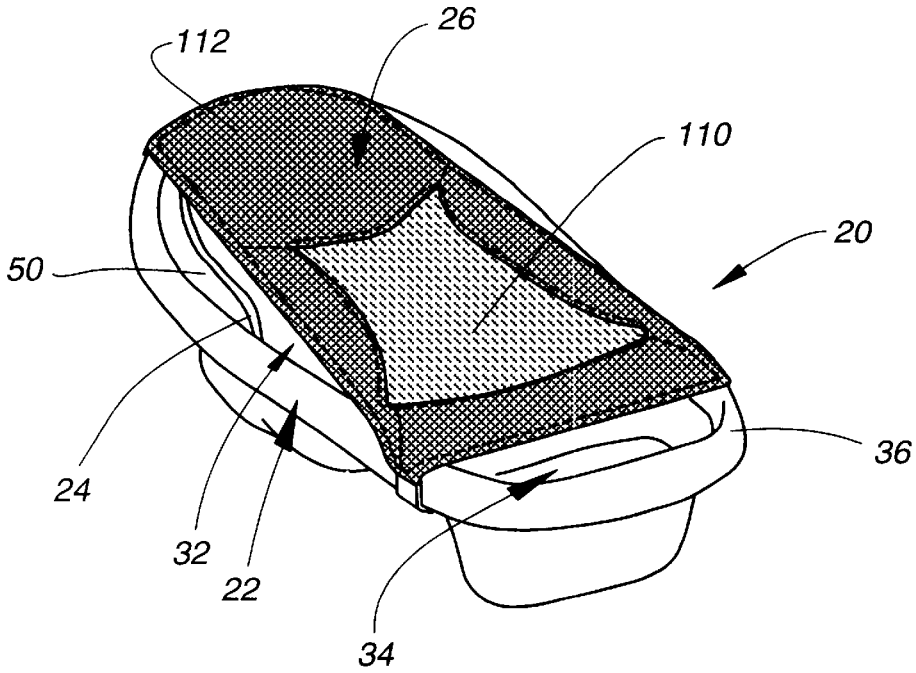
FIG. 1 is a perspective view of an infant bathtub of the present invention with a sling installed thereon.
Figure 9:
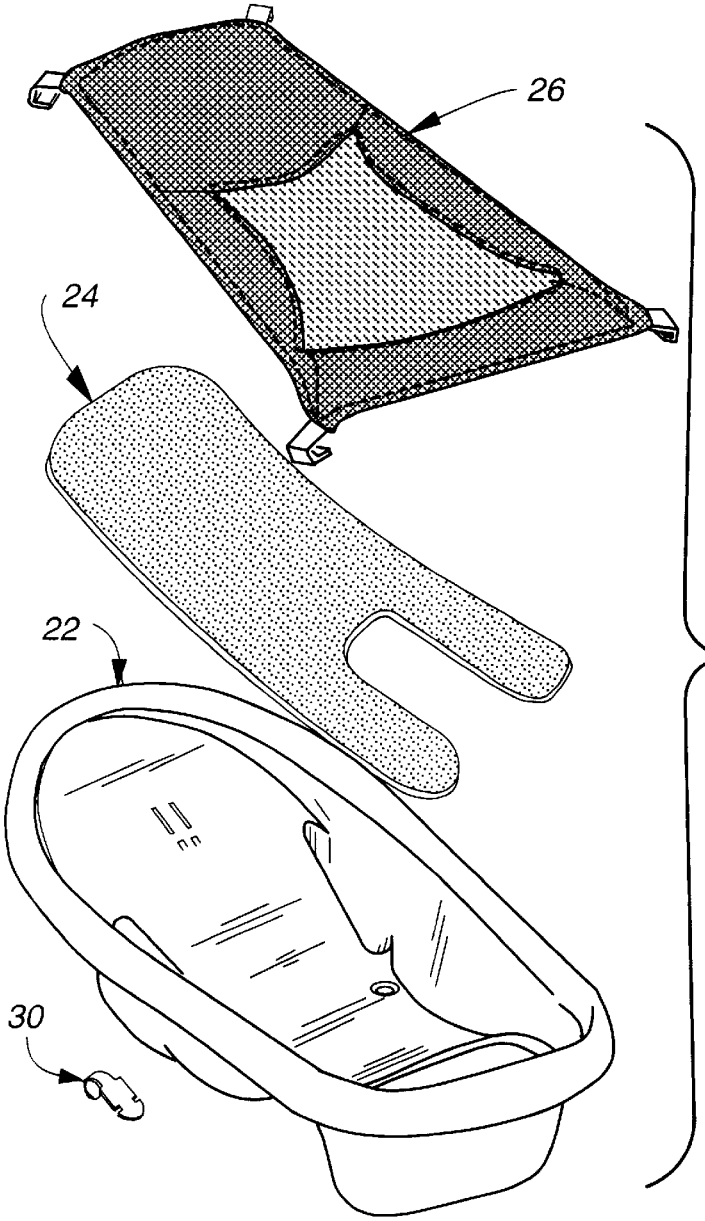
FIG. 9 is a perspective exploded view of the infant bathtub of FIG. 1.

An infant bathtub 20, as shown best in FIGS. 1 and 9, constructed according to the present invention includes a tub 22 of unitary construction, a foam pad 24 attached to an inner surface of the tub for an infant to rest thereon, a sling 26 that is selectively suspendable above the tub 22 for containing and supporting newborn infants, and a hook 30 that is selectively attachable to a bottom side of the tub 22 for suspending the infant bathtub 20 from a shower curtain rod, towel rack, or the like in order to better dry the tub out.

It should be understood that many different tub designs could be adapted to mate with the sling and hook of the present invention. As shown, the tub 22 is preferably composed of polyethene and is of unitary composition, preferably produced by injection molding. The tub 22 includes a first trough 32 that is configured and adapted for containing bath water and the infant to be bathed. The tub 22 also includes a second or auxiliary trough 34 that may receive overflow water and/or be used for storage of materials used in association with bathing the infant.

A lip 36 (FIGS. 1 and 2) is formed around the periphery of the tub 22 along a top edge thereof. Along an undersurface 40 of the lip 36, a plurality of reinforcement ribs 42 are formed thereon. In particular, a pair of ribs 44 are located at spaced-apart positions along a head end of the tub 22. These head end ribs 44 can be employed to mate with connecting hardware on the sling 26 as will be described in further detail below. Another set of spaced-apart ribs 46 are located on opposite sides of the lip 36 from each other near a foot end of the tub 22. As will also be discussed in further detail below, these foot end ribs 46 can be employed for engagement with attachment hardware associated with the sling 26. When the tub 22 is in an operative position, wherein a longitudinal axis of the tub is substantially horizontal, the tub can be seen to have an upper or front surface 50 and a lower or back surface 52.

A drain plug 54 (FIGS. 2, 9, and 10)located in one of the lowermost points of the first trough 32 provides fluid communication between the front surface 50 and the back surface 52 when removed. This allows water to be drained from the bottom of the tub 22 while it is still in the operative position. With the plug 54 in place, water will not drain from the tub 22 while in the operative position.

Figure 2:
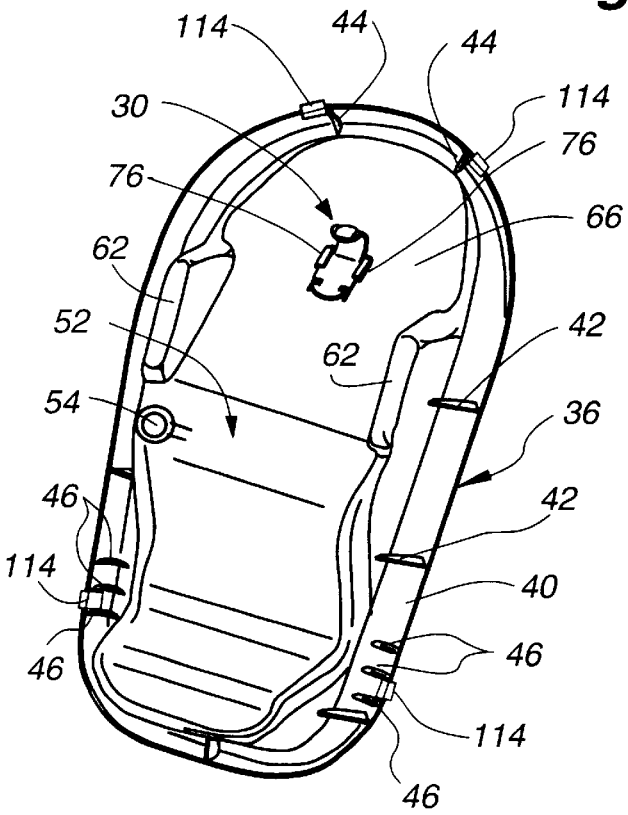
FIG. 2 is a perspective view of a bottom side of the infant bathtub of FIG. 1, showing a hook installed thereon.
Figure 3:
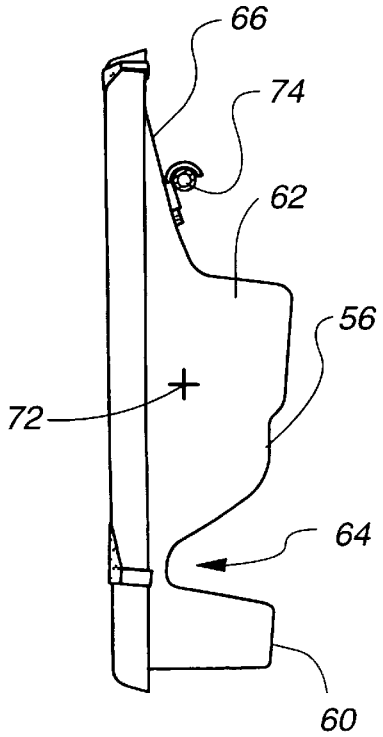
FIG. 3 is a side view of the infant bathtub of FIG. 2, shown hanging from a shower curtain rod.

As seen in FIGS. 2 and 3, the back surface 52 of the tub 22 includes trough bottoms 56 and 60 that correspond to the first trough 32 and second trough 34, respectively. The trough bottoms 56 and 60 are located at an approximately equal distance from the lip 36. A pair of feet 62 extend downward from the back surface 52 in the vicinity of the first trough bottom 56. The bottom of the pair of feet 62 are approximately the same distance from the lip 36 as is the second trough bottom 60. Since the bottom of the pair of feet 62 and the second trough bottom 60 are co-linear, the tub 22 can rest on these feet 62 and bottom 60 when the tub 22 is in a substantially horizontal or operating position. This may be the configuration when the tub 22 is placed onto a flat countertop (not shown) or onto the bottom surface of a full-sized bathtub (not shown).

As can be seen in FIGS. 2 and 3, the back surface 52 of the tub 22 also includes a recess 64 defined thereon between the first and second trough bottoms 56 and 60. In addition, the back surface 52 includes a substantially-linear sloped surface portion 66 extending from the vicinity of the first trough bottom 56 to the lip 36 at the head end of the tub 22. When it is desired to place the tub 22 in a conventional household sink, such as a double-basin kitchen sink, the tub 22 can be positioned so that the recess 64 aligns with the central divider portion of the conventional double-basin sink and the sloped surface portion 66 of the back surface 52 of the tub 22 rests on an outer edge of the sink.

Figure 5:
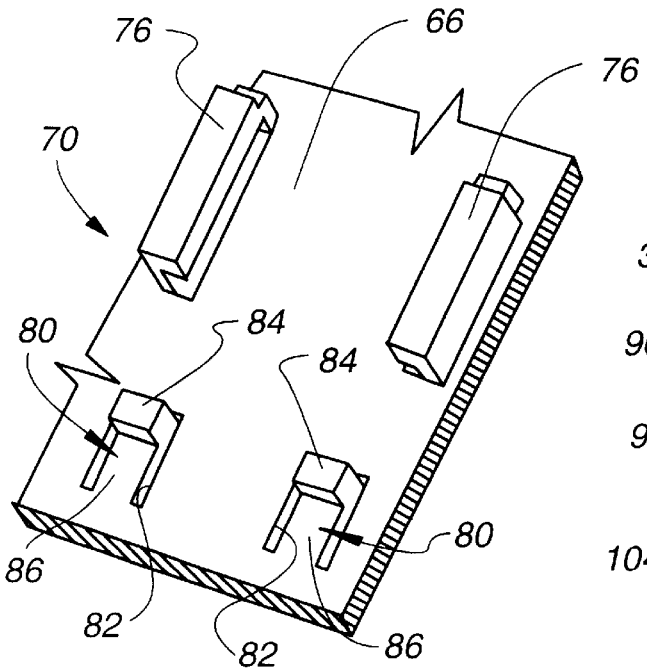
FIG. 5 is a view similar to FIG. 4, with the hook shown removed from the bottom surface of the tub.
Figure 6:
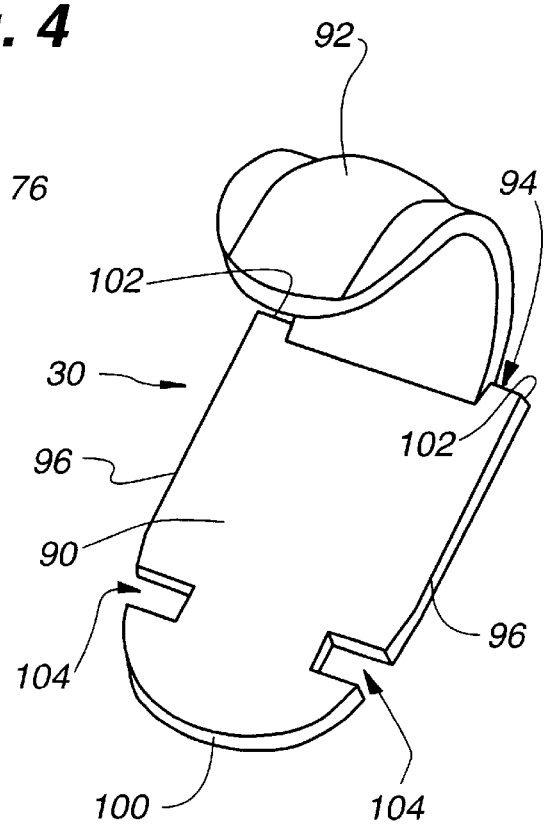
FIG. 6 is a perspective view of the hook when removed from the tub.
Figure 7:
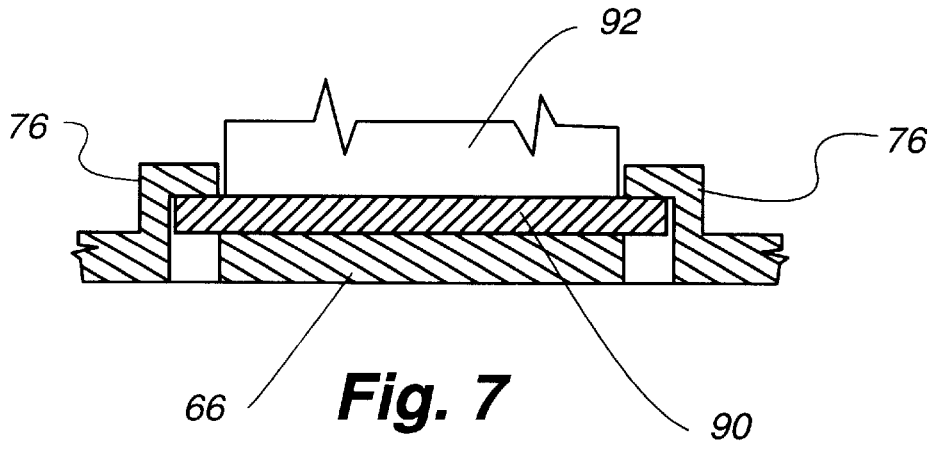
FIG. 7 is a cross-sectional view taken along line 7—7 of FIG. 4.
Figure 8:
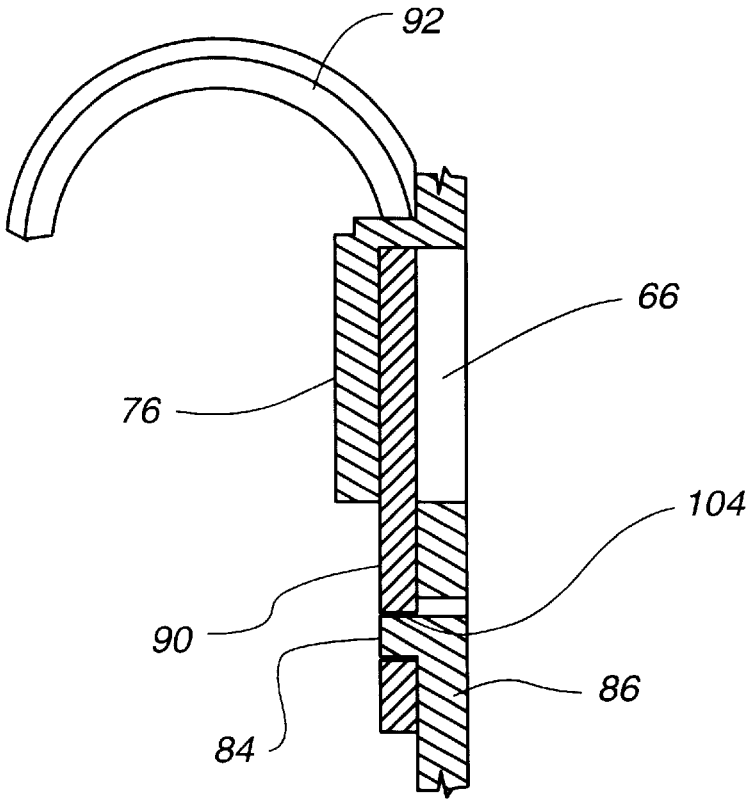
FIG. 8 is a cross-sectional view taken along line 8—8 of FIG. 4.

A receptacle 70 (FIG. 5) is defined on the back surface 52 in a position below the back and head of an infant that may occupy the tub. The receptacle 70 is proximate to and substantially equidistant between the pair of feet 62. In addition, as is shown best in FIG. 3, the receptacle 70 is positioned along the sloped surface portion 66 at a location that is substantially equal in distance from the lip 36 as is a center of mass 72 for the tub 22. In this manner, when the hook 30 is installed into the receptacle 70 and the tub is hung from a shower curtain rod 74 the infant bathtub 20 will tend to hang in a orientation wherein its longitudinal axis is substantially vertical.

The receptacle 70 could include any means of receiving the hook . As is shown in best in FIGS. 4–8, the receptacle includes a pair of closed-end channels 76. The channels 76 are L-shaped in cross-section and are substantially parallel to each other. Alternatively, the channels 76 could be configured differently so as not to be parallel, and in that case the channels need not have a closed end.

The receptacle 70 also includes a pair of resilient finger tabs 80 that reside in slots 82 formed in the tub 22. The resilient finger tabs 80 are of a unitary construction with the tub 22, being integrally formed from the tub 22 at one end thereof. At an opposite end of each of the resilient finger tabs 80 is a raised tab portion 84. Each of the resilient finger tabs 80 also include a finger portion 86 connecting the raised tab portion 84 to the tub 22. Because of the attachment of the resilient finger tabs 80 at only one end to the tub 22, and because of the resilient nature of the polyethene of which the entire tub 22 is composed, the raised tab portion 84 of the finger tabs 80 can be deflected under force, as occurs when the hook 30 is slid into the receptacle 70.

The foam pad 24 (FIGS. 1 and 9) is preferably composed of closed-cell polyethylene foam. The foam pad 24 is preferably provided with a coating of permanent adhesive to allow the foam pad 24 to be adhered to the front surface 50 of the tub 22 within the first trough 32. The foam pad 24 is primarily used to increase the comfort of the infant bathing in the bathtub 20, as well as to increase the friction between the infant and the bathtub 20 so that the infant does not easily slide around within the bathtub 20. In addition, the foam pad 24 provides the additional benefit of covering the slots 82 associated with the resilient finger tabs 80, so that there is no fluid communication between the interior of the first trough 32 and the back surface 52 of the tub 22 through the slots 82. In this manner, leakage of water through the slots 82 is prevented.

The hook 30 (FIG. 6) is preferably composed of polystyrene. The hook 30 includes a base portion 90 and a hook portion 92 integrally formed with the base portion 90, by a suitable process such as injection molding. The base portion 90 is tongue-shaped, having a relatively flat upper edge 94, a pair of relatively flat side edges 96 and a curved bottom edge 100. The outer portions of the upper edge 94 act as shoulders 102 that bear against the closed end of the channels 76 when the hook 30 is installed into the receptacle 70. The base portion 90 also includes a pair of cut-outs or notches 104 at spaced-apart positions along the bottom edge 100. The notches 104 are positioned relative to the shoulders 102 so that when the hook 30 is installed in the receptacle 70 and the shoulders 102 bear against the closed ends of the channels 76, the raised tab portion 84 of the resilient finger tabs 80 will mate with the notches 104. The thickness of the base portion 90 is approximately equal to the height of the raised tab portion 84 of the resilient finger tabs 80, so that when the hook 30 is installed in the receptacle 70, the raised tab portion 84 of the resilient finger tabs 80 is flush with the base portion 90. This prevents the hook 30 from being accidentally disengaged from the receptacle 70, as well as reduces the number of non-smooth edges on the infant bathtub 20.

The hook portion 92 of the hook 30 features a radius of curvature that is sufficiently larger than the radius of curvature of typical shower curtain rods, towel racks, and the like. In addition, the radius of curvature of the hook portion 92 is not so large as to cause the infant bathtub 20 to be unstable when suspended from a shower curtain rod 74, as shown in FIG. 3.

Figure 4:
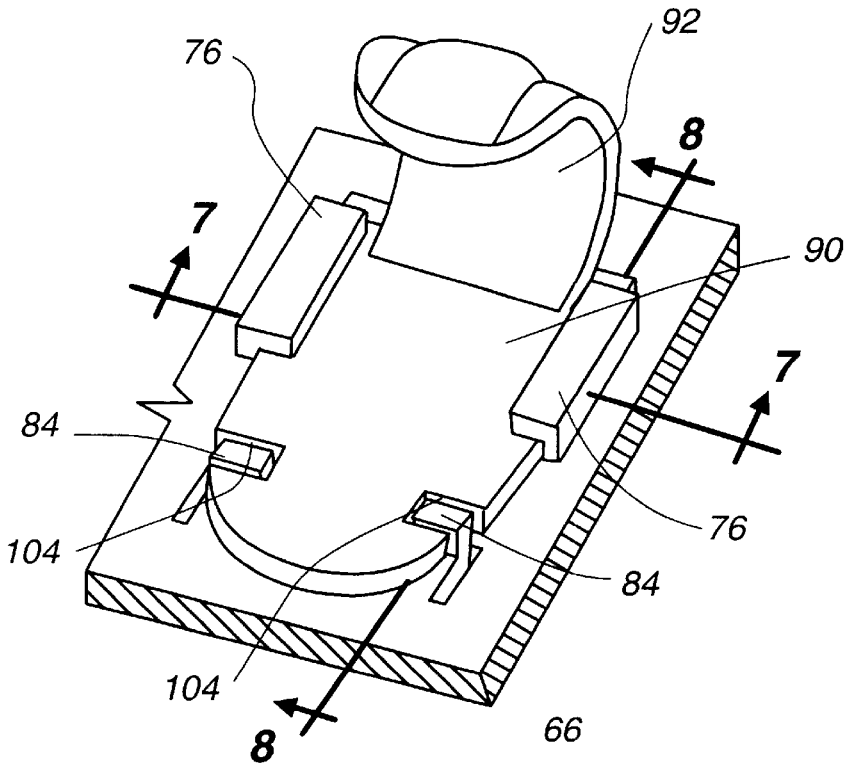
FIG. 4 is a close-up perspective view of the hook installed on a bottom surface of the tub, with the remainder of the tub broken away.

Preferably, the tub 22 and hook 30 are manufactured separately and the hook 30 is then installed into the receptacle 70 on the tub 22 prior to shipping the infant bathtub 20 to customers. Alternatively, the hook 30 could be left uninstalled providing the installation of the hook 30 as an option to the customers. Either way, when the hook 30 is slid into the receptacle 70, the base portion 90 of the hook 30 bears against the raised tab portion 84 of the resilient finger tabs 80 and causes the finger tabs 80 to deflect to allow the hook 30 to slide into the receptacle 70. Once the hook 30 is slid sufficiently into the receptacle 70, the finger tabs 80 pop back up into engagement with the notches 104, as is shown in FIG. 4. Once the hook 30 has been installed into the receptacle 70, it is not easily removed therefrom. This is because of the use of the two resilient finger tabs 80, as well as the flush nature of the fit of the raised tab portion 84 of the resilient finger tabs 80 in the notches 104. Nevertheless, should it be desired, the hook 30 can be removed from the receptacle 70 by actuating the raised tab portion 84 of the resilient finger tabs 80 together to deflect the raised tab portion 84 of the resilient finger tabs 80 sufficiently so that the hook 30 can be slid out of the receptacle 70. Tools, such as screwdrivers, may be required to perform this operation.

Figure 10:
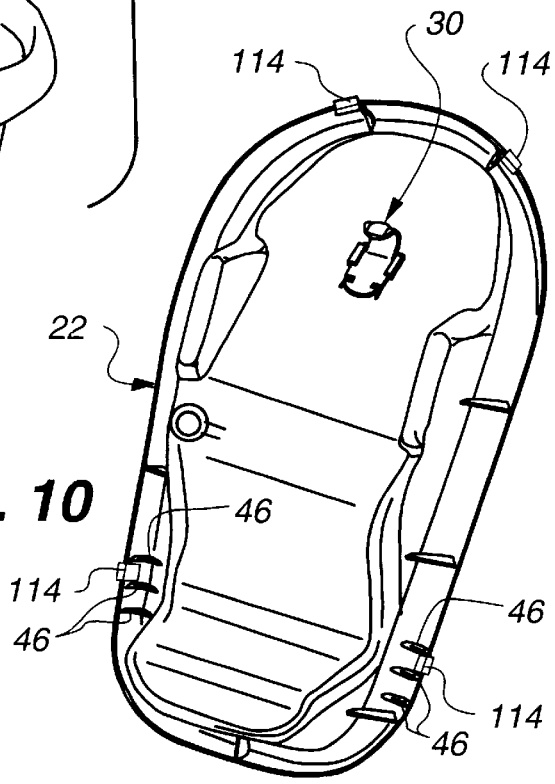
FIG. 10 is a perspective view of the bottom side of the infant bathtub as shown in FIG. 2, showing the sling attached to a different portion of the tub.

The sling 26 (FIGS. 1 and 9) is preferably composed of a nylon material The sling 26 preferably includes a fabric mesh portion 110 and a fabric non-mesh portion 112. The sling 26 is generally trapezoidal in shape and includes four attachment clips 114 (FIGS. 1, 2, 9, and 10), one sewn to the fabric portion 112 at each corner of the trapezoid. The attachment clips 114 are preferably composed of high-density polyethylene (HDPE) material. The attachment clips 114 are J-shaped and configured so that they can be clipped onto the lip 36 of the tub 22 when it is desired to install the sling 26 onto the tub 22. The attachment clips 114 at the head end of the sling 26 can be positioned adjacent to and just outside of the head end ribs 44, as shown in FIG. 2. The attachment clips 114 at the foot end of the sling 26 can be positioned in various positions relative to the foot end ribs 46, as shown in FIGS. 2 and 10. By selecting the particular position of the foot end attachment clips 114 relative to the foot end ribs 46, the tension of the sling 26 can be adjusted. This may be desirable for use with infants of various weights.

The sling 26 can be easily and quickly dried by removing it from the tub 22 and hanging it in a suitable place, or by leaving it on the tub 22. Due to the nature of the material from which the sling 26 is composed, it will quickly dry.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

What is claimed is:

1. An infant bathtub selectively suspendable from a shower curtain rod or the like, comprising:

a tub having a first end and a second end and a front side configured and adapted for containing liquid when the tub is in an operative position, the tub also having a back side with portions thereof adapted for resting on a support surface when the tub is in the operative position, the back side having a receptacle defined thereon proximate to the first end; and a hook having features defined thereon for mating with the receptacle on the back side of the tub, the hook being selectively attachable to the receptacle on the back side of the tub the hook having an outer curved surface facing generally toward the first end when the hook is attached to the receptacle and an inner curved surface facing generally toward the second end when the hook is attached to the receptacle, with the inner curved surface being adapted for resting on a shower curtain rod to allow the tub to be supported therefrom in a primarily vertical orientation with the first end being uppermost and the second end being lowermost.

2. An infant bathtub as defined in claim 1, wherein the hook is selectively attachable to and detachable from the back side of the tub.

3. An infant bathtub selectively suspendable from a shower curtain rod or the like, comprising:

a tub having a front side configured and adapted for containing liquid when the tub is in an operative position, the tub also having a back side with portions thereof adapted for resting on a support surface when the tub is in the operative position, the back side having a receptacle defined thereon; and a hook having features defined thereon for mating with the receptacle on the back side of the tub, the hook being selectively attachable to the receptacle on the back side of the tub;

wherein the tub is configured and adapted so that a longitudinal axis of the tub is substantially vertical when the tub is suspended by the hook.

4. An infant bathtub as defined in claim 3, wherein the hook includes a hook portion shaped so that the portion of the hook portion contacting the shower curtain rod when the tub is suspended by the hook is substantially aligned with a center of mass of the tub when the longitudinal axis is substantially vertical.

5. An infant bathtub as defined in claim 1, wherein the hook includes a base portion and a hook portion, the base portion having features that mate with the receptacle.

6. An infant bathtub selectively suspendable from a shower curtain rod or the like, comprising:

a tub having a front side configured and adapted for containing liquid when the tub is in an operative position, the tub also having a back side with portions thereof adapted for resting on a support surface when the tub is in the operative position, the back side having a receptacle defined thereon; and a hook having features defined thereon for mating with the receptacle on the back side of the tub, the hook being selectively attachable to the receptacle on the back side of the tub;

wherein the hook includes a base portion and a hook portion, the base portion having features that mate with the receptacle;

wherein the receptacle includes a pair of spaced-apart channels for slidably receiving the base portion of the hook.

7. An infant bathtub as defined in claim 6, wherein the pair of channels are L-shaped in cross-section.

8. An infant bathtub as defined in claim 6, wherein the pair of channels are open at one longitudinal end and closed at an opposite longitudinal end, forming a closed end.

9. An infant bathtub as defined in claim 8, wherein the base portion includes a pair of spaced-apart shoulders at an end thereof, each of the pair of shoulders bearing against the closed end of a respective one of the pair of channels, when the hook is attached to the receptacle on the back side of the tub.

10. An infant bathtub as defined in claim 6, wherein one of the receptacle and the hook includes at least one resilient tab engageable with a mating surface defined on the other of the receptacle and the hook.

11. An infant bathtub as defined in claim 10, wherein the at least one resilient tab is configured and adapted to be deflected out of an engaging position while the hook is being moved into the receptacle.

12. An infant bathtub as defined in claim 11, wherein the resilient tab includes a finger portion attached at one end to the tub, the finger portion having a raised tab portion at an opposite end.

13. An infant bathtub as defined in claim 12, wherein the tub includes two resilient tabs and the hook includes two notches defined in the base portion thereof for selective engagement by the raised tab portion of the two resilient tabs, each notch corresponding to one of the tabs.

14. An infant bathtub as defined in claim 13, wherein each notch includes a cut-out portion along a side of the base portion of the hook.

15. An infant bathtub as defined in claim 14, wherein the raised tab portion of the resilient tabs has an upper surface that is substantially aligned with an upper surface of the base portion.

16. A method of manufacturing an infant bathtub with a hook for suspending the bathtub from a shower rod curtain or the like, comprising:

producing a bathtub having a first end and a second end and having a receptacle defined on a back side thereof proximate to the first end;

producing a hook separately from the bathtub; and sliding the hook into the receptacle to attach the hook to the receptacle, the hook having an outer curved surface facing generally toward the first end when the hook is attached to the receptacle and an inner curved surface facing generally toward the second end when the hook is attached to the receptacle, with the inner curved surface being adapted for resting on a shower curtain rod to allow the tub to be supported therefrom in a primarily vertical orientation with the first end being uppermost and the second end being lowermost.

17. An infant bathtub, comprising:

a tub adapted and configured for containing fluid therein, the tub having a lip with an uppersurface that defines an upper edge of the tub and with an undersurface having a plurality of physically spaced ribs that extend downward from the undersurface of the lip; and a sling selectively suspendable from the upper edge of the tub, the sling having a plurality of connecting members engageable with the lip and prevented from sliding on the lip due to physical engagement of the connecting members with the ribs that extend downward from the undersurface of the lip.

18. An infant bathtub as defined in claim 17, wherein the sling is frameless.

19. An infant bathtub, comprising:

a tub adapted and configured for containing fluid therein, the tub having a lip defined along an upper edge thereof, a plurality of ribs defined on the lip, a foot end, a curved head end, and a pair of sides with at least one rib on each of the sides; and a sling selectively suspendable from the upper edge of the tub, the sling having four connecting members engageable with the lip and the ribs defined on the lip, two of the four connecting members being engaged with the lip on the curved head end, and one of the four connecting members being engageable with the lip on each of the two sides.

20. An infant bathtub as defined in claim 19, wherein the tub has more than one rib on each of the sides so that the connecting members can be selectively engaged with a selected one of the more than one rib.

* * * * *